United States Patent [19]

Mitsuhashi et al.

[11] Patent Number: 4,640,882

[45] Date of Patent: Feb. 3, 1987

[54] IMAGE FORMING METHOD OF NEGATIVE LATENT IMAGES USING SILICA PARTICLES

[75] Inventors: Yasuo Mitsuhashi, Yokohama; Masaki Uchiyama; Kazunori Murakawa, both of Tokyo; Kenji Okado, Yokohama, all of Japan

[73] Assignee: Canon Kabushiki Kaisha, Tokyo, Japan

[21] Appl. No.: 628,839

[22] Filed: Jul. 9, 1984

[30] Foreign Application Priority Data

Jul. 19, 1983 [JP] Japan ..... 58-131341

[51] Int. Cl.[4] ..... G03G 9/10

[52] U.S. Cl. ..... 430/110; 430/126

[58] Field of Search ..... 430/108, 109, 110, 111, 430/106.6, 116, 126

[56] References Cited

U.S. PATENT DOCUMENTS

| | | | |
|---|---|---|---|
| 3,617,333 | 11/1971 | Brown | 428/404 |
| 3,720,617 | 3/1973 | Chatterji et al. | 430/110 |
| 3,939,087 | 2/1976 | Vijayendran et al. | 430/116 |
| 3,983,045 | 9/1976 | Jugle et al. | 430/110 |
| 4,072,796 | 2/1978 | Reinhardt | 428/405 |
| 4,397,941 | 8/1983 | Fickes | 430/110 |
| 4,430,409 | 2/1984 | Matsumoto et al. | 430/106.6 |
| 4,513,074 | 4/1985 | Nash et al. | 430/106.6 |

FOREIGN PATENT DOCUMENTS

| | | | |
|---|---|---|---|
| 2630564 | 1/1977 | Fed. Rep. of Germany . | |
| 03237 | 1/1978 | Japan | 430/110 |
| 135855 | 10/1980 | Japan | 430/110 |
| 1347318 | 2/1974 | United Kingdom . | |
| 1402010 | 8/1975 | United Kingdom . | |
| 205277A | 1/1981 | United Kingdom . | |
| 2114312 | 8/1983 | United Kingdom . | |
| 2128764 | 5/1984 | United Kingdom . | |

*Primary Examiner*—John L. Goodrow

*Attorney, Agent, or Firm*—Fitzpatrick, Cella, Harper & Scinto

[57] ABSTRACT

A negative latent image is formed on a photosensitive member comprising an organic photoconductive material. The negative latent image is developed with a positively chargeable developer containing positively chargeable fine silica particles adapted to the organic photosensitive member. The developed image is transferred to a transfer material and the residual toner on the photosensitive member is removed. Thus, copied images without fog can be obtained successively.

19 Claims, No Drawings

IMAGE FORMING METHOD OF NEGATIVE LATENT IMAGES USING SILICA PARTICLES

BACKGROUND OF THE INVENTION

This invention relates to a novel image forming method with the use of a photosensitive member comprising an organic photoconductive material, particularly to an image forming method capable of forming images without fog by use of a toner containing positively chargeable nfine silica particles.

Various organic photoconductive polymers, including polyvinylcarbazole as a typical example, have been proposed as photoconductive materials to be used in electrophotographic photosensitive members. These polymers are superior to inorganic photoconductive materials such as selenium, cadmium sulfide and zinc oxide in various respects such as film forming property, light weight, high productivity, etc. In recent years, in place of polymeric materials, a large number of organic materials of lower molecular weight have also been developed for organic photoconductive materials. Such a low molecular weight organic photoconductive material is advantageous in that it gives a photoconductive material having high sensitivity. This is realized by choice of a material having good sensitivity and charge retentivity from a broader scope of compounds which can be chosen. However, photosensitive members comprising organic photoconductive materials have the drawback of lesser surface hardness and being susceptible to flaws.

On the other hand, a positively chargeable toner to be used for development of negative latent images on a photosensitive member comprising an organic photoconductive material generally contains a positive charge controller. Such positive charge controllers include generally amino compounds, quaternary ammonium compounds, organic dyes, particularly basic dyes and salts thereof. Conventional positive charge controllers include benzylmethyl-hexadecylammonium chloride, decyltrimethylammonium chloride, nigrosine, safraniney, and crystal violet. These are usually added into a thermoplastic resin, dispersed by melting under heating and micropulverized into fine particles, adjusted to suitable sizes, if desired, and then provided for use as a toner.

However, these dyes as charge controllers have complicated structures and do not have constant properties, thus being poor in stability. Also, decomposition or denaturation may occur through decomposition, mechanical shock and friction during kneading under heat or change in temperature and humidity conditions, to cause lowering in the charge controlling characteristic.

Accordingly, when development is carried out by use of a toner containing these dyes as charge controllers in a copying machine, the dyes may undergo decomposition or denaturation as the number of copies increases to cause deterioration of the toner.

As another serious disadvantage, it is very difficult to disperse these dyes as charge controllers evenly into a thermoplastic resin, and therefore difference in triboelectric charge is liable to occur among the toner particles obtained by crushing of the mixture.

Most of dyes for positive charge controlling are hydrophilic and therefore, due to poor dispersibility of these dyes into a resin, the dyes are exposed at the toner surfaces when pulverized after fusion kneading. When the toner is used under highly humid conditions, images of good quality cannot be obtained because of hydrophilic nature of the dye.

Thus, when a dye having positive charge controlling characteristic of the prior art is used in a toner, variances in amount of the charges generated on the toner particle surfaces through friction among between toner particles, between toners and carriers or between toners and toner carrying member such as sleeve, will occur, whereby various inconveniences are caused, such as development fog, toner scattering, carrier contamination, etc. Also, under highly humid conditions, the transfer efficiency of the toner image is markedly lowered to be unsuitable for practical use. Even under normal temperature and humidity, when the toner is stored for a long time, due to instability of the positive charge controlling dye employed, toner particles may frequently agglomerate to become useless.

The research group to which we belong has proposed a toner containing fine silica particles synthesized by a wet process suitable for development of negative latent images in Japanese Laid-open Patent Application No. 78549/1982 and others. When this toner was used, however, for development of negative images on a photosensitive member comprising an organic photoconductive material and a large number of copies were taken under an environment of low temperature and low humidity, it was found that fine silica particles were caused to adhere onto the surface of the photosensitive member and the copied images were susceptible to fogging. This may be attributable to the following reason. The fine silica particles synthesized by the wet process have greater primary particle sizes and further are more susceptible to agglomeration than fine silica particles synthesized by a dry process, thus forming larger particles (about 1 micron). Also, since the fine silica particles synthesized by the wet process are liable to be charged negatively, through friction with the toner particles, positive charges are given to the toner particles, while they are themselves charged negatively. As the result, the fine silica particles synthesized by the wet process tend to be attached onto the non-image portion on the latent image, and further, in the transfer step, cannot be transferred onto a transfer paper because of having the polarity opposite to that of the toner, but remain abundantly on the photosensitive member. Further, since the silica consists of fine particles and has also great hardness, the silica remaining on a photosensitive member is liable to form flaws on the photosensitive member. Therefore, when image formation is effected repeatedly, the silica particles will become attached onto the photosensitive member to cause fog on the copied image. This tendency becomes further pronounced under low humidity environment, because of increased triboelectric charge.

Further, for overcoming this problem, in various cleaning methods, such as the blade cleaning system, the fur brush cleaning system, the magnetic brush cleaning system, etc., measures have been investigated to give as little load as possible to the toner and the photosensitive member. However, it could not completely be overcome by such measures.

SUMMARY OF THE INVENTION

Therefore, an object of the present invention is to provide a novel image forming method which has overcome the drawbacks as described above.

Another object of the present invention is to provide an image forming method having excellent developing characteristic and being capable of giving an image which is clear and without fog.

Still another object of the present invention is to provide an image forming method which changes little in various characteristics corresponding to the changes in environmental conditions.

A further object of the present invention is to provide an image forming method in which the quality of copied product will not be lowered during repeated uses.

According to the present invention, there is provided an image forming method, comprising the steps of: forming a negative latent image on a photosensitive member comprising an organic photoconductive material, developing said latent image with a positively chargeable toner, transferring the developed image obtained to a transfer material, and cleaning the residual toner on the photosensitive member, wherein the positively chargeable toner comprises colored resinous particles and positively chargeable fine silica particles.

DETAILED DESCRIPTION OF THE INVENTION

The positively chargeable fine silica particles in the present invention are defined as follows. That is, 2 g of fine silica particles which have been left to stand overnight in an environment of 25° C. and relative humidity of 50 to 60% and 98 g of carrier iron powder not coated with a resin having a major particle size in the range of 200 to 300 mesh (e.g. EFV 200/300, produced by Nippon Teppun K.K.) are mixed thoroughly in an aluminum pot having a volume of about 200 cc in the same environment as mentioned above (by shaking the pot in hands vertically for about 50 times), and the triboelectric charge of the fine silica particles is measured according to the conventional blow-off method by means of an aluminum cell having a 400 mesh screen. The fine silica particles having positive triboelectric charge through the above measurement are defined as positively chargeable fine silica particles.

The positively chargeable fine silica particles of the present invention should preferably have a triboelectric charge of $\oplus 10\ \mu c/g$ or more, particularly $\oplus 30\ \mu c/g$ or more. Specifically, they can be prepared by subjecting the silica formed by vapor phase oxidation of a silicon halide further to a treatment with a silane coupling agent, a titanium coupling agent, silicone oil, etc.

The "silica formed by vapor phase oxidation of a silicon halide" is the so called "dry process silica" or "fumed silica", and it can be produced according to the techniques which per se are known in the art. For example, it can be obtained by pyrolytic oxidation of gaseous silicon tetrachloride in oxygen-hydrogen flame. The basic reaction scheme may be represented as follows:

$$SiCl_4+2H_2+O_2 \rightarrow SiO_2+4HCl$$

In the above preparation step, it is also possible to obtain complex fine powder of silica and other metal oxides by using other metal halides such as aluminum chloride or titanium chloride together with silicon halides, and they are also included in the silica formed by vapor phase oxidation of a silicon halide of the present invention, which will be sometimes referred to as "fumed silica" herein.

It is preferred to use fumed silica particles, of which mean primary particle size is desirably within the range of from 0.001 to 2μ, namely within the range of from about 30 to 500 $m^2/g$ in terms of specific surface area (BET specific surface area according to the nitrogen adsorption method).

Commercially available fumed silica particles to be used in the present invention include those sold under the trade names as shown below.

| | |
|---|---|
| AEROSIL | 130 |
| (Nippon Aerosil Co.) | 200 |
| | 300 |
| | 380 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK N 20 | V 15 |
| (Wacker-Chemie GMBH) | N 20E |
| | T 30 |
| | T 40 |
| D-C Fine Silica | |
| (Dow Corning Co.) | |
| Fransol | |
| (Fransil Co.) | |

In the prior art, an example of adding fine silica particles formed by vapor phase oxidation of a silicon halide to a developer is known. However, even a developer containing a dye having positive charge controllability will be changed in chargeability to negative by addition of such silica, and it has not been suitable for visualization of negative electrostatic images.

In the method of applying a positively chargeable toner containing fine silica particles synthesized by the wet process suitable for developing negative latent images for a photosensitive member comprising an organic photoconductive material as previously proposed by out research group, the fine silica particles in the toner remaining on the photosensitive member without being transferred will become markedly greater in content. However, in the image forming method of the present invention, the content is not so much. Specific examples are shown below, but the percentage of the silica in the toner remaining on the photosensitive member without being transferred after successive copying of 1000 sheets with an original having image ratio of 6% was measured to be 1.5 to 4 times as much as the silica content in the toner before use in the case of the method employing the fine silica particles synthesized by the wet process, while it was 1.3 times or less in the present invention.

In the present invention, for treatment of the fine silica particles formed by vapor phase oxidation of silicon halides, it is preferred to use a treating agent containing an amine group. Examples of such a treating agent include silane coupling agents as set forth below:

$$H_2NCH_2CH_2CH_2Si(OCH_3)_3$$
$$H_2NCH_2CH_2CH_2Si(OC_2H_5)_3$$

-continued $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$
$H_2NCH_2CH_2NHCH_2CH_2CH_2Si(OCH_3)_3$
$H_2NCH_2CH_2NHCH_2CH_2NHCH_2CH_2CH_2Si(OCH_3)_3$
$H_5C_2OCOCH_2CH_2NHCH_2CH_2CH_2Si(OCH_3)_3$
$H_5C_2OCOCH_2CH_2NHCH_2CH_2NHCH_2CH_2CH_2Si(OCH_3)_3$
$H_5C_2OCOCH_2CH_2NHCH_2CH_2NHCH_2CH_2NHCH_2CH_2NHCH_2CH_2CH_2Si(OCH_3)_3$
$H_3COCOCH_2CH_2NHCH_2CH_2NHCH_2CH_2CH_2Si(OCH_3)_3$ $(H_5C_2)_2N-CH_2CH_2CH_2Si(OCH_3)_3$

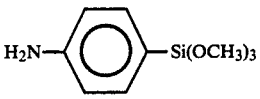

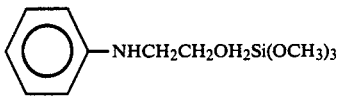

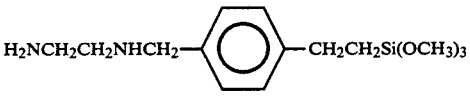

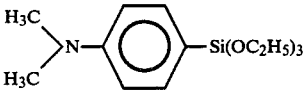

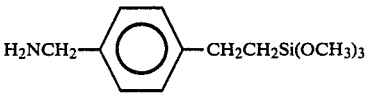

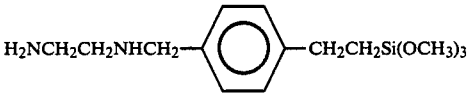

$(HOCH_2CH_2)_2N-CH_2CH_2CH_2Si(OCH_3)_3$ $(H_3CO)_3SiCH_2CH_2CH_2-NHCH_2$
$(H_3CO)_3SiCH_2CH_2CH_2-NHCH_2$ $(H_5C_2O)_3SiCH_2CH_2CH_2)_2NH$
$(H_5C_2O)_3SiCH_2CH_2CH_2$ $H_3CNHCH_2CH_2CH_2Si(OC_2H_5)_3$
$H_2N(CH_2CH_2NH)_2CH_2CH_2CH_2Si(OCH_3)_3$
$H_3C-NHCONHC_3H_6Si(OCH_3)_3$, and modified silicone oils having an amine group in the side chain of the general formula shown below:

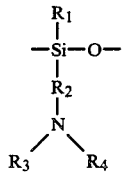

wherein $R_1$ represents hydrogen, alkyl, aryl or alkoxy, $R_2$ represents alkylene or phenylene, $R_3$ and $R_4$ each represent hydrogen, alkyl or aryl, with proviso that the above alkyl, aryl, alkylene and phenylene may contain an amine group and also have substituents such as halogens within the range which does not impair the charging characteristic.

Examples of such silicone oils include those as shown below:

| Trade name | Viscosity at 25° C. (cps) | Amine equivalent |
|---|---|---|
| SF8417 (Toray-Silicone K.K.) | 1200 | 3500 |
| KF392 (Shinetsu Kagaku K.K.) | 60 | 360 |
| KF857 (Shinetsu Kagaku K.K.) | 70 | 830 |
| KF860 (Shinetsu Kagaku K.K.) | 250 | 7600 |
| KF861 (Shinetsu Kagaku K.K.) | 3500 | 2000 |
| KF862 (Shinetsu Kagaku K.K.) | 750 | 1900 |
| KF864 (Shinetsu Kagaku K.K.) | 1700 | 3800 |
| KF865 (Shinetsu Kagaku K.K.) | 90 | 4400 |
| KF369 (Shinetsu Kagaku K.K.) | 20 | 320 |
| KF383 (Shinetsu Kagaku K.K.) | 20 | 320 |
| X-22-3680 (Shinetsu Kagaku K.K.) | 90 | 8800 |
| X-22-380D (Shinetsu Kagaku K.K.) | 2300 | 3800 |
| X-22-3801C (Shinetsu Kagaku K.K.) | 3500 | 3800 |
| X-22-3810B (Shinetsu Kagaku K.K.) | 1300 | 1700 |

The amine equivalent refers to the equivalent (g/equiv) per amine group, and it is a value obtained by dividing the molecular weight with the number of amine groups per molecule.

The fine silica particles to be used in the present invention should preferably exhibit a hydrophobicity of 30 or above, particularly within the range of from 30 to 80 as measured by the methanol titration test. For treatment to obtain such a hydrophobicity, a conventional method for hydrophobicity modification known in the art may be used. For example, it can be imparted by chemical treatment of fine silica particles with an organic silicon compound which can react with or be physically adsorbed by fine silica particles. As a preferable method, the fine silica particles formed by vapor phase oxidation of silicon halides are treated with an organic silicon compound after or simultaneously with the treatment with the silane coupling agent as mentioned above.

Examples of the organic silicon compounds include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, and further dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per molecule and containing each one hydroxyl group bonded to Si at the terminal units and the like. These may be used alone or as a mixture of two or more compounds.

The methanol titration test employed here is an experimental test conducted for confirmation of the extent of hydrophobicity of the fine silica particles subjected to hydrophobic modification.

The "methanol titration test" defined in the present specification for evaluation of hydrophobicity is conducted as follows.

Sample fine silica powders (0.2 g) are charged into 50 ml of water in 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the hydrophobicity is represented by the percentage of the methanol in the liquid mixture of water and methanol on reaching the end point.

The fine silica particles applicable in the present invention may be 0.01 to 20% based on the weight of the developer (total weight of toner and fine silica particles) to exhibit the effect, particularly preferably 0.1 to 3% to exhibit positive charging characteristic having excellent stability. To mention about a preferred mode of addition, it is preferred that the fine silica particles should be attached onto the surfaces of the toner particles in an amount of 0.01 to 3 wt. % based on the weight of the developer.

The organic photoconductive material which can be used in the present invention may include those employing organic photoconductive polymers such as polyvinyl carbazole, etc. and those employing low molecular weight organic photoconductive substances and insulating polymers as binders. Among them, it is preferred to use a laminate type photosensitive member comprising a charge transporting layer and a charge generating layer. The charge generating layer is formed by dispersing a charge generating substance, selected from azo pigments such as Sudan Red, Dian Blue, Jenous Green B, etc.; quinone pigments such as Algol Yellow, pyrenequinone, Indanthrene Brilliant Violet RRP; quinocyanine pigments; perylene pigments; indigo pigments such as indigo, thioindigo, etc.; bis-benzoimidazole pigments such as Indofast Orange Toner; phthalocyanine pigments such as Copper Phthalocyanine; Quinacridone pigments and the like, in a binder regin such as polyester, polystyrene, polyvinyl butyral, polyvinyl pyrrolidone, methyl cellulose, polyacrylates, cellulose ester, etc. Its thickness may be 0.01 to 1μ, preferably about 0.05 to 0.5μ.

On the other hand, the charge transporting layer is formed by dissolving a positive hole transporting substance such as compounds having skeletons or basic structures of polycyclic aromatic compounds such as anthracene, pyrene, phenanthrene, coronene, etc. or nitrogen-containing cyclic compounds such as indole, carbazole, oxazole, isooxazole, thiazole, imidazole, pyrazole, oxadiazole, pyrazoline, thiadiazole, triazole, etc. in the main chain or the side chain, or hydrazone compounds in a resin having film forming property. This is because charge transporting substances are generally poor in film forming property. Such resins include polycarbonate, polymethacrylates, polyallylate, polystyrene, polyester, polysulfone, styrene-acrylonitrile copolymer, styrene-methyl methacrylate copolymer, etc. The thickness of the charge transporting layer may preferably be 5 to 20μ.

For the resin constituting the surface layer of a photosensitive member such as the charge transporting layer, other properties such as abrasion resistance, lubricating properties, etc. are also important and, in order to achieve effectively the object of the present invention, the resin is desired to have a Tg at the peak position measured by DSC (Differential Scanning Calorimeter) of 60° C. or higher, particularly preferably 80° C. or higher.

The surface hardness of the OPC photosensitive member, i.e., the photosensitive member using an organic photoconductor, to be used in the present invention should preferably be 10 g or more, particularly preferably 12 to 100 g, as measured by the method shown below:

An OPC photosensitive member is fixed on a sample stand of, for example, a HEIDON 14 type Surface Characteristic Measuring Machine (produced by Shinto Kagaku, K.K.), a vertical load×g is applied through a diamond needle (shaped in cone, with a cone angle of 90°, but the tip is semispherical with a diameter of 0.01 mm) on the OPC photosensitive member and the sample stand is moved at a speed of 50 mm/min., thereby forming a flaw on the surface of the OPC photosensitive member. The width of the flaw is measured by, for example, a microscope attached to a minute hardness tester MVK-F (produced by Akashi Seisakusho K.K.).

The above operation is repeated by changing the load×g as, for example, 10 g, 15 g, 20 g, 25 g, 30 g, 35 g, 40 g, . . . , and, from the relationship of linear regression between the flaw width and the load, the load for forming a flaw with a width of 50μ is calculated and defined as the hardness of the OPC photosensitive member. In the case of a drum-shaped OPC photosensitive member, the OPC photosensitive member is set on the sample stand so that a flaw may be formed in the shaft direction of the drum.

Further, it is preferred to use a resin containing 30% by weight or more, more preferably 50% by weight or more, particularly preferably 70% by weight or more of a vinyl polymer.

The vinyl polymer is a homopolymer of a vinyl monomer or a copolymer of two or more vinyl monomers, and vinyl monomers include styrene, p-chlorostyrene, vinyltoluene, methyl methacrylate, acrylonitrile, N-vinylcarbazole and the like. Further, the vinyl polymer may also be a copolymer of a vinyl monomer with a monomer such as a diene monomer copolymerizable with the vinyl monomer.

The positively chargeable toner of the invention is given by the combination of the above described positively chargeable fine silica particles and colored resinous particles. The colored resinous particles comprise a binder resin and a colorant.

The binder resin for the toner of the present invention may be composed of homopolymers of styrene and derivatives thereof such as polystyrene, poly-p-chlorostyrene, polyvinyltoluene, and the like; styrene copolymers such as styrene-propylene copolymer, styrene-vinyltoluene copolymer, styrene vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-isoprene copolymer, styrene-acrylonitrileindene copolymer, styrene-maleic acid copolymer, styrene-maleic acid ester copolymer, and the like; polymethyl mechacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenol resins, aliphatic or alicyclic hydrocarbon resins, aromatic petroleum resin, chlorinated paraffin, paraffin wax, etc. These binder resins may be used either singly or as a mixture.

As the colorant to be used in the toner of the present invention, pigments or dyes known in the art such as carbon black, iron black, etc. may be employed, and all the dyes known in the art as positive charge controllers can be used in combination with the treated fine silica particles to be used in the present invention. Examples of such dyes include benzyldimethylhexadecylammonium chloride, decyl-trimethylammonium chloride, nigrosine, safraninеy and crystal violet. It is preferable that the toner component other than the positively chargeable silica particles is equally positively chargeable.

Further, the toner of the present invention may also contain as desired, lubricants, abrasives, fixing aids, etc. Examples of such additives include polytetrafluoroethylene powder, polyvinylidene fluoride powder, metal salts of higher fatty acids, cerium oxide, low molecular weight polyethylene, low molecular weight polypropylene, etc.

In order to use the toner of the present invention in the form of a magnetic toner, magnetic powder may also be incorporated therein. Such magnetic powder may be of a substance magnetizable when placed in a magnetic field such as powder of strongly magnetic metals, for example, iron, cobalt, nickel, etc. or alloys and compounds such as magnetite, hematite, ferrite, and others. The magnetic powder may preferably be contained in an amount of 10 to 70% by weight based on the toner weight.

For improvement of free flowing property or charging characteristic of the toner, fine silica particles may also be contained in the toner particles. In this case, the fine silica particles may be either positively or negatively chargeable depending on the purpose.

Further, the toner of the present invention can be mixed, if desired, with carrier particles such as iron powder, glass beads, nickel powder, ferrite powder, etc. to be used as a developer for electrostatic latent images.

The developing method applicable in the present invention may include the magnetic brush developing method, the cascade developing method, the method as disclosed in U.S. Pat. No. 3,909,258 in which conductive magnetic toner is used, the method as disclosed in Japanese Laid-open Patent Application No. 31136/1978 in which high resistivity magnetic toner is used, the methods as disclosed in Japanese Laid-open Patent Applications Nos. 42121/1979, 18656/1980 and 43027/1979, the fur brush developing method, the powder cloud method, the impression developing method, the touch down method, and others.

The transfer method to be used in the present invention may be any one of the methods known in the art such as the electrostatic transfer system, the bias roll system, the pressure pathway transfer system, the magnetic transfer system, etc. Further, the method for cleaning the residual toner on the photosensitive member to be used in the present invention may be any one known in the art, including the blade cleaning system, the fur brush cleaning system, the magnetic brush cleaning system and others. It is also possible to provide a step for removing electricity immediately before the cleaning step to make cleaning easier, if desired.

In the image forming method of the present invention, it is preferred to employ the blade cleaning system which provides an excellent combination with the toner and the photosensitive member of the present invention.

EXAMPLE 1

A blend of 100 parts by weight of a styrene-butyl methacrylate-dimethylaminoethyl methacrylate (weight ratio=7:2.5:0.5) copolymer, 60 parts by weight of magnetite and 3 parts by weight of polyethylene wax was melted and kneaded on a roll mill. After cooling, the mixture was coarsely crushed by a hammer mill and finely pulverized by means of a jet pulverizer. Then, the powder was classified by use of a wind force classifier to obtain black powder with particle sizes of about 5 to 20μ.

On the other hand, while stirring 100 parts by weight of fine silica particles (specific surface area: about 130 $m^2/g$) synthesized by the dry process and maintaining the temperature at about 250° C., 15 parts of silicone oil having amine groups in the side chain (viscosity at 25° C. of 70 cps, amine equivalent: 830) were sprayed on the particles to treat the particles for 10 minutes. The resultant treated silica particles were found to have a triboelectric charge of ⊕150 μc/g and a hydrophobicity of 67.

A toner was prepared by adding 0.3 part of the silica particles treated with the silicone oil having amine groups in the side chain to 10 parts of the above black fine particles.

On the other hand, a laminate type photosensitive member was prepared, wherein the charge transporting layer is constituted of a methyl methacrylate-styrene (weight ratio: 9:1) copolymer having a Tg of 80° C. or higher as measured by DSC and has a hardness of 21 g as measured by the method as described above, and this photosensitive member and the above toner were applied to a commercially available copying machine (trade name, PC-20, produced by Canon K.K.) to carry out image formation. As the result, clear images without fog could be obtained. Also, under high temperature and high humidity (30° C., 90% RH) conditions, clear images with high density could be obtained. Further, under low temperature and low humidity (15° C., 10% RH) conditions, with the use of an original of image ratio of 6%, successive copying test was conducted for 1,000 sheets of copying to obtain the result that no filming was observed on the photosensitive member surface. The amount of the silica in the toner recovered in the cleaner was found to be 0.34 wt. %.

COMPARATIVE EXAMPLE 1

Example 1 was repeated except for using the silica synthesized by the wet process (specific surface area: about 90 $m^2/g$, triboelectric charge ⊖14 μc/g) in place of the fine silica particles in Example 1. As the result, good images could be obtained under high temperature and high humidity environment. However, after successive copying test for 1,000 sheets of copying under the low temperature and low humidity, marked filming was observed on the photosensitive member surface. And, the amount of silica in the toner recovered in the cleaner was found to be 0.59 wt. %.

COMPARATIVE EXAMPLE 2

Example 1 was repeated except for using untreated fine silica particles (triboelectric charge ⊖70 μc/g). Only poor imagescould be obtained.

COMPARATIVE EXAMPLE 3

Example 1 was repeated except for using a laminate type photosensitive member of which the charge transporting layer is constituted of a butyl methacrylate-styrene copolymer having a Tg as measured by DSC of 50° C. Under the low temperature and low humidity conditions, although good images were initially obtained, marked filming occurred soon later.

EXAMPLE 2

Example 1 was repeated except for preparing a photosensitive member having a hardness of 26 g by use of polymethyl methacrylate having a Tg of 80° C. or higher in place of the methyl methacrylate-styrene copolymer in Example 1. Good results could be obtained.

EXAMPLE 3

Example 1 was repeated except for preparing a photosensitive member having a hardness of 15 g by use of a styrene-acrylonitrile copolymer having a Tg of 80° C. or higher in place of the methyl methacrylate-styrene copolymer in Example 1. Good results could be obtained.

EXAMPLE 4

In place of the fine silica particles in Example 1, fine silica particles (hydrophobicity: 51, triboelectric charge: ⊕190 μc/g) formed by treating 100 parts by weight of the fine particles synthesized by the dry process (specific surface area: about 200 $m^2/g$) with 20 parts by weight of aminosilane coupling agent (aminopropyltrimethoxysilane) and 10 parts by weight of hexamethylenedisilane were employed, following otherwise substantially the same procedure as in Example 1. When continuous copying test was conducted for 1,000 sheets of copying under the low temperature and low humidity conditions, no filming occurred. The amount of silica in the toner recovered in the cleaner was found to be 0.29%.

When the above procedure was repeated with the use of an OPC photosensitive member employing polyvinylcarbazole, good results could be obtained.

For reference, fine silica particles obtained in the member as described above except for not using hexamethylene disilane were found to have a hydrophobicity of 0.

EXAMPLE 5

Fine silica particles were treated in the manner shown in Example 1 except for using 8 parts by weight of aminoethylaminopropyltrimethoxysilane and 7 parts by weight of hexamethyldisilazane in place of the silicone oil having the amine groups. The thus treated fine silica particles were found to have a triboelectric charge of ⊕90 μc/g and a hydrophobicity of 50. A toner was obtained by using the fine silica particles and subjected to successive copying test of 1000 sheets under the low temperature and low humidity conditions as in Example 1, whereby no filming was observed and good results were obtained.

EXAMPLE 6

Fine silica powder obtained through the dry process (specific surface area: about 200 $m^2/g$) in an amount of 100 parts by weight were treated with 10 parts by weight of diethylaminopropyltrimethoxysilane and 10 parts of hexamethyldisilazane in the manner as described in Example 1. The thus treated fine silica particles, were found to have a triboelectric charge of ⊕140 μc/g and a hydrophobicity of 45 and, by using the treated silica particles, the procedure of Example 1 was repeated, whereby good results were obtained.

What is claimed is:

1. An image forming method comprising the steps of:
(i) forming a negative latent image on a photosensitive member comprising an organic photoconductive material,
(ii) developing said latent image with a positively chargeable dry toner,
(iii) transferring the developed image obtained to a transfer material, and
(iv) cleaning the residual toner on the photosensitive member,
wherein said positively chargeable dry toner comprises colored resinous particles and positively chargeable fine silica particles which have been obtained by treating fumed silica particles having a mean primary particle size of 0.001 to 2μ to provide positive chargeability.

2. An image forming method according to claim 1, wherein the positively chargeable toner is comprised of 0.01 to 20 wt. % of the positively chargeable fine silica particles.

3. An image forming method according to claim 1, wherein the fumed silica particles have been formed by vapor phase oxidation of a silicon halide compound.

4. An image forming method according to claim 1, wherein the positively chargeable fine silica particles have a hydrophobicity of 30 or above as measured by the methanol titration test.

5. An image forming method according to claim 1, wherein the positively chargeable fine silica particles have a hydrophobicity of 30 or above as measured by the methanol titration test and have a BET specific surface area of 30 to 500 $m^2/g$.

6. An image forming method according to claim 5, wherein the positively chargeable fine silica particles have a triboelectric charge of ⊕10 μc/g or more.

7. An image forming method according to claim 1, wherein the surface layer of the photosensitive member comprises a resin having a Tg of 60° C. or above.

8. An image forming method according to claim 1, wherein the photosensitive member has a surface hardness of 10 g or more based on the load for forming a flaw with a width of 50μ.

9. An image forming method according to claim 1, wherein the surface layer of the photosensitive member comprises a resin containing 30% by weight or more of a vinyl polymer.

10. An image forming method according to claim 1, wherein the surface layer of the photosensitive member comprises a resin containing 50% or more of a vinyl polymer.

11. An image forming method according to claim 1, wherein the organic photoconductive material has a laminated structure comprising a charge transporting layer and a charge generating layer.

12. An image forming method according to claim 8, wherein the photosensitive member has a surface hardness of 10 g or more, comprises a resin having a Tg of 60° C. or above and has a laminated structure comprising a charge transporting layer and a charge generating layer.

13. A positively chargeable dry toner for a photosensitive member having an organic photoconductive material, comprising colored resinous particles and positively chargeable fine silica particles which have been obtained by treating fumed silica particles having a mean primary size of 0.001 to 2μ to provide positive chargeability.

14. A positively chargeable dry toner according to claim 13, wherein the colored resinous particles are positively chargeable.

15. A positively chargeable toner according to claim 13, wherein the positively chargeable fine silica particles have been formed by vapor phase oxidation of a silicon halide compound.

16. A positively chargeable toner according to claim 13, wherein the organic photoconductive material has a laminated structure comprising a charge transporting layer and a charge generating layer.

17. An image forming method according to claim 2, wherein the positively chargeable toner is comprised of 0.1–3 wt. % of the positively chargeable fine silica particles.

18. An image forming method according to claim 1, wherein the positively chargeable fine silica particles have been obtained by treating the fumed silica particles with a treating agent containing an amine group.

19. An image forming method according to claim 18, wherein the treating agent is a silane coupling agent, a titanium coupling agent or silicone oil, each having an amine group.

* * * * *